US006481358B2

(12) United States Patent
Theurer et al.

(10) Patent No.: US 6,481,358 B2
(45) Date of Patent: Nov. 19, 2002

(54) TRACK TAMPING METHOD AND MACHINE

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/873,677

(22) Filed: Jun. 4, 2001

(65) Prior Publication Data

US 2001/0050022 A1 Dec. 13, 2001

(30) Foreign Application Priority Data

Jun. 9, 2000 (AT) ..... 431/00 U

(51) Int. Cl.[7] ..... E01B 27/00
(52) U.S. Cl. ..... 104/2; 104/7.1; 104/12
(58) Field of Search ..... 104/2, 5, 7.1, 7.2, 104/7.3, 10, 12

(56) References Cited

U.S. PATENT DOCUMENTS

| | | | | |
|---|---|---|---|---|
| 4,632,037 A | * | 12/1986 | Theurer et al. | 104/12 |
| 4,635,557 A | * | 1/1987 | Mohr et al. | 104/12 |
| 4,644,868 A | | 2/1987 | Theurer et al. | |
| 4,733,614 A | * | 3/1988 | Mohr et al. | 104/12 |
| 4,794,862 A | | 1/1989 | Theurer | |
| 5,619,929 A | * | 4/1997 | Theurer | 104/12 |
| 6,154,973 A | * | 12/2000 | Theurer et al. | 104/12 |

FOREIGN PATENT DOCUMENTS

GB 2 151 675 7/1985

* cited by examiner

*Primary Examiner*—Mark T. Le
(74) *Attorney, Agent, or Firm*—Collard & Roe, P.C.

(57) ABSTRACT

In a first operating stage during which ballast is delivered to a track section delimited by two undercarriages while it is lifted, the length of the track section is extended, and the track section is shortened in a second operating stage during which the ballast is tamped until a desired track level has been obtained.

3 Claims, 2 Drawing Sheets

Fig. 1
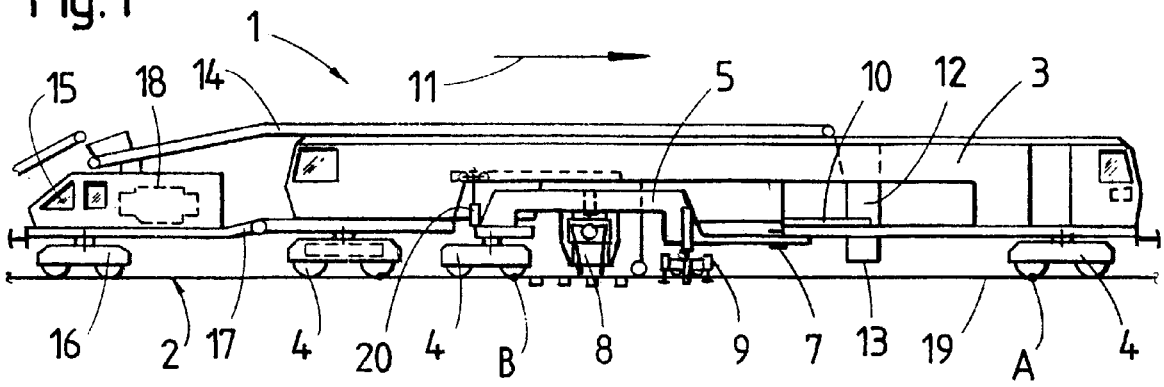
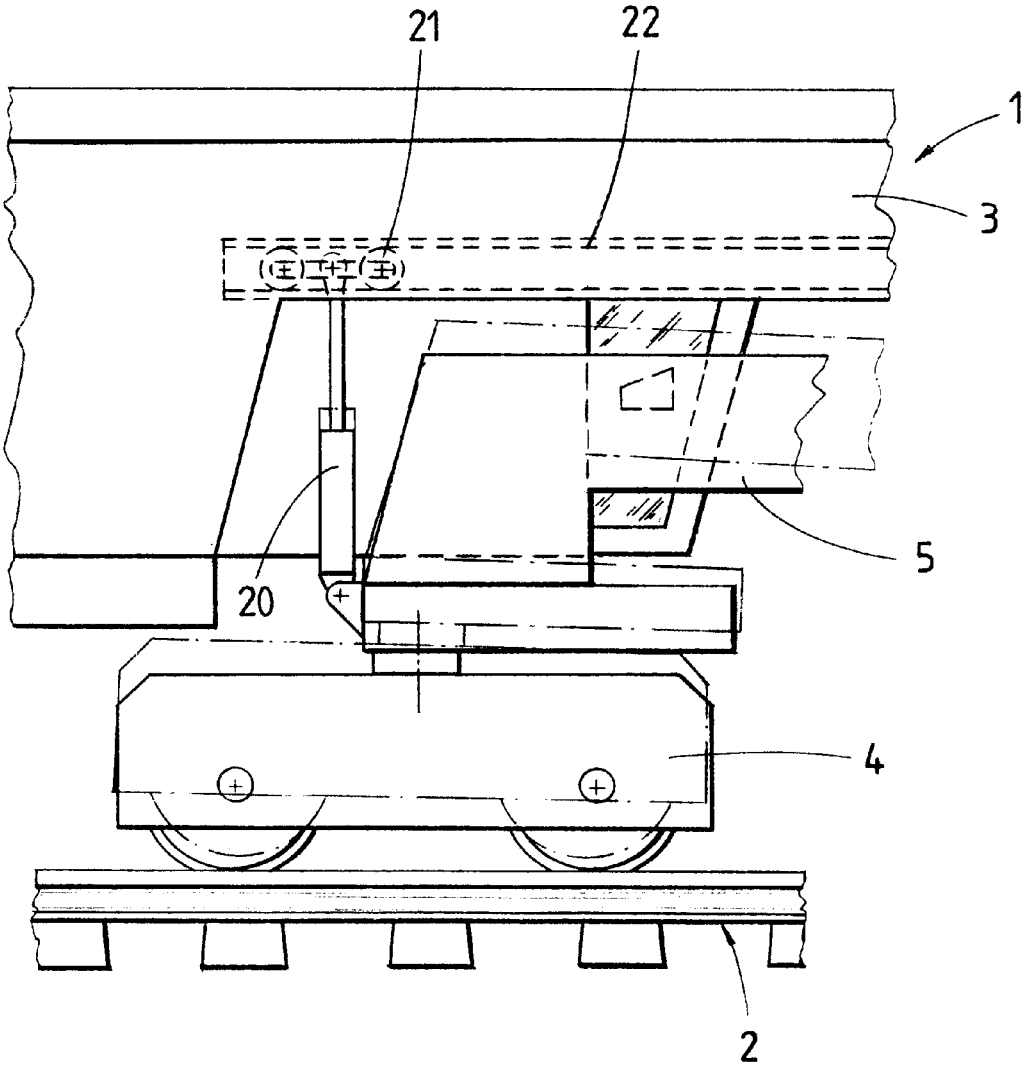
Fig. 2

TRACK TAMPING METHOD AND MACHINE

BACKGROUND OF THE INVENTION

1. Field of the Invention

The present invention relates to a method and machine for tamping ballast under a track in a track section delimited by two undercarriages.

2. Description of the Prior Art

British patent No. 2,151,675 discloses a tamping machine comprising a main frame having opposite ends supported on undercarriages delimiting a track section which is lifted and tamped. A longitudinally displaceable satellite frame is arranged between the undercarriages, and the satellite frame is equipped with a track tamping unit and a track leveling and lining unit. The tamping machine advances continuously along the track during a track rehabilitation operation while the displaceable satellite frame moves intermittently for tamping the ballast under the successive ties of the track in the track section.

U.S. Pat. No. 4,644,868 also discloses such a continuously advancing track leveling, lining and tamping machine. One end of the satellite frame is supported by an undercarriage on the track, and the track is lifted and the ballast is tamped in a track section delimited by one of the undercarriages supporting the main frame on the track and the undercarriage supporting the one satellite frame end on the track.

Finally, U.S. Pat. No. 4,794,862 discloses a track tamping machine which comprises a chute for discharging ballast in the track section being lifted and tamped. This optimizes the track correction operation by providing sufficient ballast to assure a long-lasting corrected track position.

SUMMARY OF THE INVENTION

It is the primary object of this invention to improve track tamping by permitting newly delivered ballast to be tamped rapidly and efficiently under the ties of a track.

It is another object of the invention to provide a track tamping machine which is alternately usable for optimal tamping of newly delivered ballast and a normal tamping operation.

The above and other objects of the present invention are accomplished according to one aspect of this invention with a method of tamping ballast under a track in a track section delimited by two undercarriages, which comprises the steps of extending the length of the track section in a first operating stage during which ballast is delivered to the track while the track is lifted, and shortening the track section in a second operating stage during which the ballast is tamped until a desired track level has been obtained.

Lifting of the track section to a higher level is possible by extending the length of the track section without subjecting the track rails to undue stress as they are bent during lifting. This higher track lift has the advantage that a substantial amount of ballast may be delivered in a single operating stage for tamping under the ties of the track, particularly in connection with a new ballasting of the track. As soon as all the required ballast has been disposed under the track, the track section may be shortened in a second operating stage to obtain a desired track level and tamp the ballast under the ties for achieving a durable corrected track position.

According to another aspect of the invention, there is provided a mobile machine for tamping ballast under a track, which comprises a main frame extending in a longitudinal direction and having opposite ends supported on the track by two undercarriages, and a satellite frame arranged between the two under carriages and having opposite ends, one of the satellite frame ends having a link connecting the one satellite frame end to the main frame for displacement in the longitudinal direction, the opposite satellite frame end having another undercarriage for support on the track, and the satellite frame carrying a tamping unit and a track leveling and lining unit. A lifting drive connects the opposite satellite frame end to the main frame, and guide rollers are connected to the lifting drive for moving the lifting drive in the longitudinal direction.

Providing the lifting drive movable on the guide rollers in the longitudinal direction enables the length of the track section to be adjusted simply by actuating the lifting drive and without requiring additional work. The high efficiency of a continuously advancing track tamping machine remains unimpaired in both operating stages.

BRIEF DESCRIPTION OF THE DRAWING

The above and other objects, advantages and features of the present invention will become more apparent from the following detailed description of certain now preferred embodiments thereof, taken in conjunction with the accompanying drawing wherein FIG. 1 shows a somewhat simplified side elevation of an embodiment of a mobile tamping machine according to this invention, with a longitudinally displaceable satellite frame;

FIG. 2 is an enlarged fragmentary side elevational view showing an essential part of the tamping machine of FIG. 1, in detail;

DETAILED DESCRIPTION OF THE PREFERRED EMBODIMENTS

Figure 3:
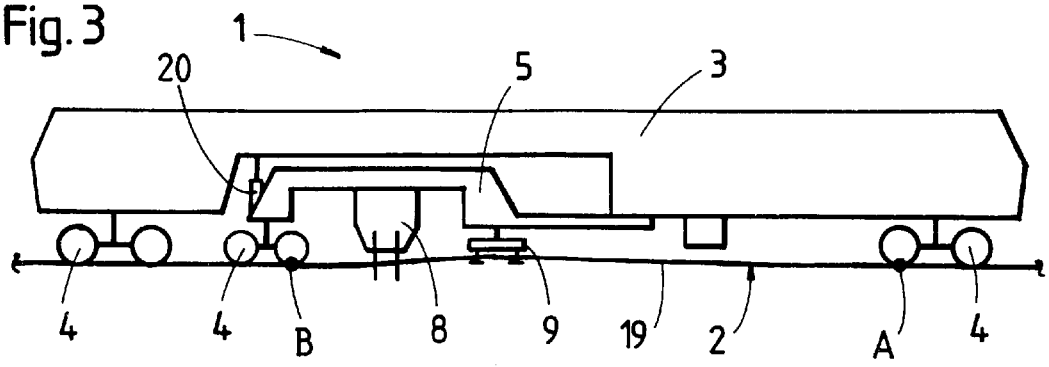
FIGS. 3 and 4 schematically illustrate the tamping machine during the second and first operating stage, respectively.

As shown in FIGS. 1 and 2, mobile machine 1 for tamping ballast under track 2 comprises elongated main frame 3 extending in a longitudinal direction and having opposite ends supported on the track by two undercarriages 4, 4. Satellite frame 5 is arranged between the two undercarriages and has opposite ends. One of the satellite frame ends has link 7 connecting the one satellite frame end to main frame 3 for displacement in the longitudinal direction. The opposite satellite frame end has another undercarriage 4 for support on track 2, and the satellite frame carries tamping unit 8 and track leveling and lining unit 9. Displacement drive 10 enables satellite frame 5 to be displaced relative to machine frame 3 in the longitudinal direction. All of this structure is conventional.

According to this invention, lifting drive 20 connects the opposite satellite frame end to main frame 3, and guide rollers 21 are connected to the lifting drive for moving the lifting drive in the longitudinal direction along guide track 22.

Chute 12 is mounted on machine frame 3 in front of satellite frame 5 and rearwardly of front undercarriage 4, with respect to an operating direction of machine 1 indicated by arrow 11, and this chute has discharge ports 13 above track 2 for delivering ballast to the track. Furthermore, elongated ballast delivery conveyor 14 is mounted on machine frame 3 for conveying ballast from rear end 15 of machine 1 to chute 12. In the illustrated embodiment, frame extension 17 is linked to frame 3 at rear end 15. One end of this frame extension is supported on track 2 by undercarriage 16, and motor unit 18 is mounted on the frame extension.

Figure 5:
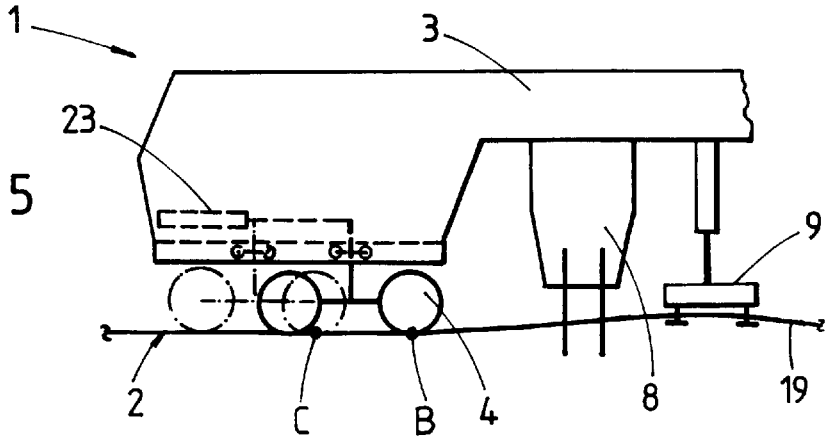
FIG. 5 shows a partial, simplified side elevation of another embodiment of the mobile tamping machine.

FIG. 5 shows mobile machine 1' for tamping ballast under track 2, which comprises frame 3' extending in a longitudinal direction and having opposite ends supported on the track by two undercarriages, only rear undercarriage 4' being shown. The rear undercarriage is displaceable in the longitudinal direction relative to frame 3' by displacement drive 23 between a position shown in full lines and another position (for an extended track section), which is shown in broken lines. Tamping unit 8' and track leveling and lining unit 9' are arranged in this embodiment directly on frame 3' between the undercarriages supporting the ends of the frame on track 2.

Figure 4:
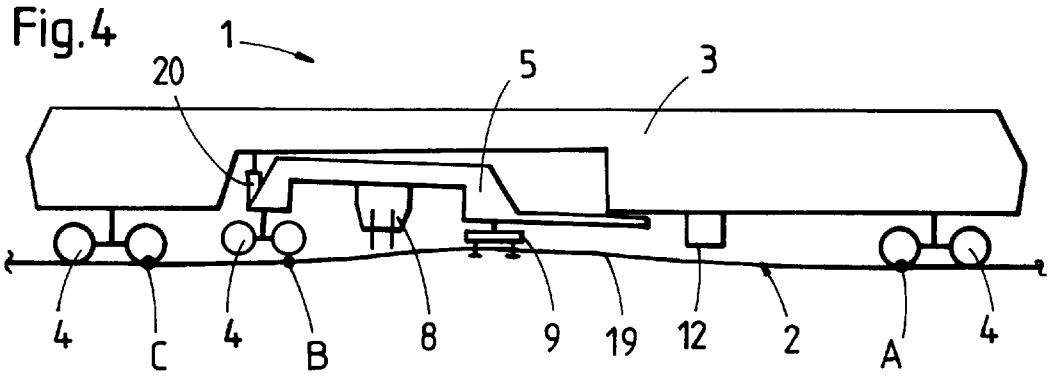

The illustrated tamping machines may be operated in the following manner for tamping ballast under track 2 in track section 19 delimited by two undercarriages 4, 4 supporting track tamping machine 1 on the track:

During normal track tamping operations, track section 19 is delimited by front undercarriage 4 supporting frame 3 on the track and undercarriage 4 supporting satellite frame 5 on the track, as indicated by points A and B in FIGS. 1 and 3. When larger amounts of ballast are delivered to track 2 in a ballasting operation, the length of track section 19 is extended in a first operating stage during which ballast is delivered to the track while the track is lifted. This is done simply and rapidly by actuating hydraulic lifting drive 20 to raise the rear end of satellite frame 5 off track 2, as shown in FIG. 4. This extends track section 19 from point 1 to point C at the rear undercarriage 4 supporting frame 3 on track 2. As shown, this enables the track to be lifted by track leveling and lining unit 9 to a higher level, allowing larger amounts of ballast to be delivered to extended track section 19. As soon as the desired amount of ballast has been delivered to track 2, track section 19 is shortened in a second operating stage during which the ballast is tamped until a desired track level has been obtained. This is done simply by releasing the pressure in hydraulic lifting drive 20 so satellite frame 5 is lowered until its undercarriage 4 runs on track 2, and track section 19 automatically resumes the shortened length between points A and B.

What is claimed is:

1. A method of tamping ballast under a track in a track section delimited by two undercarriages, comprising the steps of extending the length of the track section in a first operating stage during which ballast is delivered to the track while the track is lifted, and shortening the track section in a second subsequent operating stage during which the ballast is tamped until a desired track level has been obtained.

2. A mobile machine for tamping ballast under a track, which comprises (a) a main frame extending in a longitudinal direction and having opposite ends supported on the track by two undercarriages, (b) a satellite frame arranged between the two undercarriages and having opposite ends, (1) one of the satellite frame ends having a link connecting the one satellite frame end to the main frame for displacement in the longitudinal direction, (2) the opposite satellite frame end having another undercarriage for support on the track, and the satellite frame carrying (3) a tamping unit and (4) a track leveling and lining unit, (c) a lifting drive connecting the opposite satellite frame end to the main frame, and (d) guide rollers connected to the lifting drive for moving the lifting drive in the longitudinal direction.

3. A method of tamping ballast under a track section delimited by two undercarriages with a track tamping machine comprising a main frame supported on the track by two undercarriages and a satellite frame arranged between the two undercarriages and having one end linked to the main frame and an opposite end to which another undercarriage is connected, the satellite frame carrying a tamping unit and a track leveling and lining unit, which comprises the steps of extending the length of the track section in a first operating stage during which ballast is delivered to the track while the track is lifted by raising the satellite frame with the other undercarriage off the track whereby the track section extends between the undercarriages supporting the main frame on the track, and shortening the track section in a second operating stage during which the ballast is tamped until a desired track level has been obtained by lowering the satellite frame until the other undercarriage runs on the track whereby the track section extends between one of the undercarriages supporting the main frame on the track and the other undercarriage connected to the opposite end of the satellite frame.

* * * * *